US010156044B2

(12) United States Patent
Murase et al.

(10) Patent No.: US 10,156,044 B2
(45) Date of Patent: Dec. 18, 2018

(54) INTERSECTING TRACK AND SWITCHING DEVICE

(71) Applicant: MITSUBISHI HEAVY INDUSTRIES ENGINEERING, LTD., Kanagawa (JP)

(72) Inventors: Kosaku Murase, Tokyo (JP); Eisuke Okano, Tokyo (JP); Yutaka Doi, Tokyo (JP)

(73) Assignee: MITSUBISHI HEAVY INDUSTRIES ENGINEERING, LTD., Kanagawa (JP)

( * ) Notice: Subject to any disclaimer, the term of this patent is extended or adjusted under 35 U.S.C. 154(b) by 84 days.

(21) Appl. No.: 15/118,482

(22) PCT Filed: Feb. 18, 2015

(86) PCT No.: PCT/JP2015/054453
§ 371 (c)(1),
(2) Date: Aug. 12, 2016

(87) PCT Pub. No.: WO2015/129524
PCT Pub. Date: Sep. 3, 2015

(65) Prior Publication Data

US 2017/0183827 A1 Jun. 29, 2017

(30) Foreign Application Priority Data

Feb. 27, 2014 (JP) ..... 2014-036261

(51) Int. Cl.
*E01B 7/14* (2006.01)
*B61B 13/00* (2006.01)
*E01B 25/28* (2006.01)

(52) U.S. Cl.
CPC ..... *E01B 7/14* (2013.01); *B61B 13/00* (2013.01); *E01B 25/28* (2013.01); *E01B 2202/025* (2013.01)

(58) Field of Classification Search
CPC ..... B61B 13/00; E01B 2202/025; E01B 2202/02; E01B 2202/021; E01B 2202/022;
(Continued)

(56) References Cited

U.S. PATENT DOCUMENTS 3,366,076 A * 1/1968 Ristow ..... B65G 9/008 104/101
4,993,326 A 2/1991 Bergemann
(Continued)

FOREIGN PATENT DOCUMENTS

CN 103180512 A 6/2013
JP 50-119107 U 9/1975
(Continued)

OTHER PUBLICATIONS

International Search Report in PCT Application No. PCT/JP2015/054453, dated Mar. 31, 2015.
(Continued)

*Primary Examiner* — Mark T Le
(74) *Attorney, Agent, or Firm* — Kanesaka Berner and Partners, LLP

(57) ABSTRACT

An intersecting track includes: two main tracks; a pair of first guide portions disposed in the main tracks and guide a pair of first guide wheels of the vehicle; a pair of crossover tracks disposed over the main tracks to intersect each other; a second guide portion disposed inside each of the pair of crossover tracks and guides a second guide wheel; a switching portion that switches a direction of the vehicle to a direction along the main tracks and a direction along the
(Continued)

crossover track; and a switching device disposed in an intersecting area of the second guide portions in the pair of crossover tracks, selectively switches a direction to a direction along one of the second guide portions and a direction along the other of the second guide portions, and guides the second guide wheel in any one of the directions.

5 Claims, 6 Drawing Sheets

(58) Field of Classification Search
CPC ..... E01B 2202/024; E01B 7/14; E01B 25/28; E01B 25/12; E01B 25/00
USPC ..... 104/130.07, 130.09, 130.01, 130.05
See application file for complete search history.

(56) References Cited

U.S. PATENT DOCUMENTS

2012/0168525 A1 7/2012 Kono et al.
2013/0193277 A1* 8/2013 Kawauchi ..... E01B 25/28 246/415 R

FOREIGN PATENT DOCUMENTS

| | | | | |
|---|---|---|---|---|
| JP | 52-143602 | A | | 11/1977 |
| JP | 54-97906 | A | | 8/1979 |
| JP | 60-107102 | U | | 7/1985 |
| JP | 2-27481 | B2 | | 6/1990 |
| JP | 2002-180406 | A | | 6/2002 |
| JP | 2005-36441 | A | | 2/2005 |
| JP | 2011-84183 | A | | 4/2011 |
| JP | 2013-64312 | A | | 4/2013 |
| WO | WO2013031630 | | * | 1/2013 |

OTHER PUBLICATIONS

Written Opinion in PCT Application No. PCT/JP2015/054453, dated Mar. 31, 2015.

* cited by examiner

INTERSECTING TRACK AND SWITCHING DEVICE

RELATED APPLICATIONS

The present application is a National Phase of PCT/JP2015/054453, filed Feb. 18, 2015, and claims priority based on Japanese Patent Application No. 2014-036261, filed Feb. 27, 2014.

TECHNICAL FIELD

The present invention relates to an intersecting track on which a vehicle runs between two main tracks and a switching device which is disposed on the intersecting track.

BACKGROUND ART

As a new transportation other than a bus or a railroad, a track transportation system in which a vehicle runs on a track using running wheels including rubber tires or the like is known. Such a track transportation system is generally referred to as a new transportation system, automated guideway transit (AGT), or an automated people mover (APM).

In such a type of track transportation system, a guide wheel disposed in a vehicle comes into contact with a guide rail disposed along the track and rolls, thereby guiding the vehicle on the track.

The above-mentioned track transportation system is double-tracked by establishing two main tracks in parallel to enable vehicles to simultaneously run in two different directions. A crossover track enabling a vehicle to be transferred between the two main tracks and a switch enabling the vehicle to selectively run on the crossover track and the main tracks are provided in some sections.

For example, Patent Literature 1 discloses a track provided with a crossover track (a delivery running path) and a switch (switching means).

CITATION LIST

Patent Literature

Patent Literature 1

Japanese Unexamined Patent Application, First Publication No. 2013-64312

SUMMARY OF INVENTION

Technical Problem

However, for example, in a switching section using the crossover track described in Patent Literature 1, a vehicle can move from a first main track to a second main track only when the vehicle runs in one direction. Accordingly, when a vehicle runs in the one direction on the main track, the switching section using the crossover track needs to be installed at two positions in order to enable the vehicle to move between the main tracks and thus a section in which a vehicle moves between the main tracks, that is, the switching section, is elongated. When the switching section is elongated, an occupation range on the entire track increases and thus there is a possibility that newly introducing a track transportation system into a city will be difficult.

The present invention is made in consideration of the above-mentioned circumstances and an object thereof is to provide an intersecting track and a switching device which is disposed on the intersecting track, which can shorten a switching section with a simple constitution.

Solution to Problem

In order to achieve the aforementioned object, the present invention employs the following means.

That is, an intersecting track according to an aspect of the present invention includes: two main tracks on which a vehicle runs; a pair of first guide portions that are disposed in the two main tracks and guide a pair of first guide wheels on both side parts of the vehicle on an outside thereof; a pair of crossover tracks that are disposed over the two main tracks to intersect each other and enable the vehicle to run between the two main tracks; a second guide portion that is disposed inside each of the pair of crossover tracks and guides a second guide wheel disposed under the vehicle; a switching portion that is disposed in each of the main tracks and switches a direction of the vehicle to a direction along the main track and a direction along the crossover track; and a switching device that is disposed in an intersecting area of the second guide portions in the pair of crossover tracks, selectively switches a direction to a direction along one of the second guide portions and a direction along the other of the second guide portions, and guides the second guide wheel in any one of the directions.

According to the intersecting track, the main tracks employ a so-called side guide system in which the vehicle is guided by the first guide portions and the crossover tracks employ a so-called center guide system in which the vehicle is guided by the second guide portions. Accordingly, unlike a case in which the crossover tracks also employ the side guide system, it is possible to reduce an overlapping section which is disposed to transfer the vehicle from one of the first guide portions to the other of the first guide portions.

In the main tracks, since a vehicle is guided using the side guide system, it is possible to stably run at a high speed. Here, in order to achieve stabilization of high-speed running in the center guide system, it is necessary to dispose the guide portions at a high position. However, in this case, the structure of the main tracks or the vehicle may be further complicated and an increase in costs is unavoidable. According to the present invention, by employing the side guide system for the main tracks, it is possible to achieve both stabilization of high-speed running and suppression of an increase in costs.

The switching device can be disposed in the intersecting area of the second guide portions in the crossover tracks and the vehicle can be made to run in the center guide system by operating only the switching device. That is, even when a so-called X branch is employed in which the crossover tracks are disposed to intersect each other, it is not necessary to select a running direction of a vehicle by switching the crossover tracks as a whole. Accordingly, unlike a case in which the crossover tracks are switched as a whole, it is not necessary to use a large-scale mechanism which can support a weight of the vehicle and the like. Therefore, it is possible to limit the size of a facility to a maximum extent to suppress an increase in costs and to shorten a switching section by employing the X branch.

The switching device may include: a rotating body that is disposed to be rotatable on top surfaces of the crossover tracks with an axis passing through the center of the intersection area as a rotation axis and has a guide groove formed therein which the second guide wheel passes through and which guides the second guide wheel from both sides in a width direction of the crossover track; and a driving unit that rotationally drives the rotating body.

The running direction of a vehicle is selected by disposing the switching device and rotationally driving the rotating body. That is, since the rotating body is made to operate on a track surface of the crossover tracks, it is not necessary to dispose constituent components of the switching device below the crossover tracks. Accordingly, since the crossover tracks do not need to be disposed at a higher position, it is possible to limit the length of a prop of the crossover tracks and to limit the volume of a material (such as concrete and steel) required for constructing the prop, thereby suppressing an increase in costs.

Since the guide groove guiding the second guide wheel from the width direction is formed in the rotating body, it is possible to suppress rocking of the vehicle in the width direction of the crossover tracks to secure a course and to improve ride quality.

In the switching device, the driving unit may include: a rod portion that is disposed to be movable forward and backward in a direction intersecting the rotation axis and has a rack gear formed at a first end thereof; and a link portion that has a pinion gear which engages with the rack gear and which rotates about an axis parallel to the rotation axis in response to forward and backward movement of the rod portion and causes the rotating body to rotate in response to the rotation of the pinion gear.

By employing the driving unit for the switching device, the rotating body is rotated by a linear driving mechanism using a rod portion. Accordingly, a mechanism causing the rod portion to move forward and backward can be disposed on a plane along the track surface of the crossover tracks. Therefore, since a mechanism causing the rod portion to move forward and backward does not need to be disposed under the crossover tracks, the crossover tracks do not need to be disposed at a higher position. As a result, it is possible to limit the length of the prop of the crossover tracks and to limit the volume of a material (such as concrete and steel) required for constructing the prop.

Since the rotating body is not rotated directly but is rotated via the link portion, it is possible to absorb backlash in a rack gear and a pinion gear or displacement of the rotating body due to thermal expansion or contraction of the rod portion. Accordingly, it is possible to improve positioning accuracy of the rotating body without using a particular stopper mechanism or the like and to cause the vehicle to smoothly run on the crossover tracks.

By indirectly rotating the rotating body using the link portion, a load from the vehicle is not directly applied to a mechanism causing the rod portion to move forward and backward and it is thus possible to improve durability of the driving unit.

A switching device according to another aspect of the present invention is disposed in an intersecting track including two main tracks on which a vehicle runs, a first guide portion that is disposed in the two main tracks and guides a first guide wheel of the vehicle, a pair of crossover tracks that are disposed over the two main tracks to intersect each other and enable the vehicle to run between the two main tracks, a second guide portion that is disposed inside each of the pair of crossover tracks and guides a second guide wheel disposed under the vehicle, and a switching portion that is disposed in each of the main tracks and switches a direction of the vehicle to a direction along the main track and a direction along the crossover track. Here, the switching device is disposed in an intersecting area of the second guide portions in the pair of crossover tracks, selectively switches a direction to a direction along one of the second guide portions and a direction along the other of the second guide portions, and guides the second guide wheel in any one of the directions.

According to the switching device, the switching device is disposed in the intersecting area of the second guide portions in the crossover tracks and the vehicle can be made to run in the center guide system by operating only in the intersecting area. Accordingly, unlike a case in which the crossover tracks are switched as a whole, it is not necessary to use a large-scale mechanism which can support the weight of the vehicle and the like. Therefore, it is possible to limit the size of the facility to the maximum extent and to suppress an increase in costs.

Advantageous Effects of Invention

According to the intersecting track and the switching device, since the switching device is disposed in the intersecting area of the crossover tracks, it is possible to shorten a switching section with a simple structure.

DESCRIPTION OF EMBODIMENTS

Hereinafter, an intersecting track 1 according to an embodiment of the present invention will be described.

Figure 1:
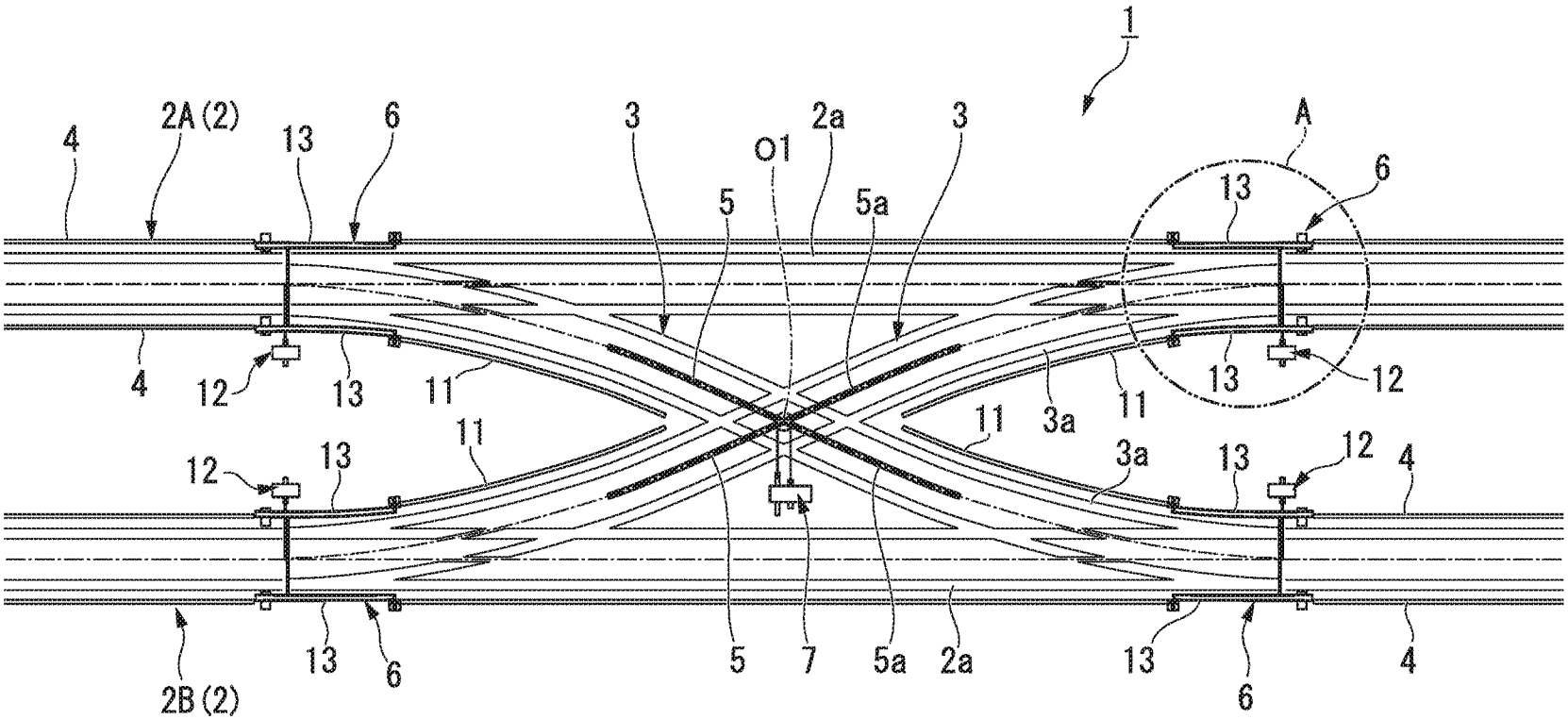
FIG. 1 is a top view showing an intersecting track according to an embodiment of the present invention.
Figure 2:
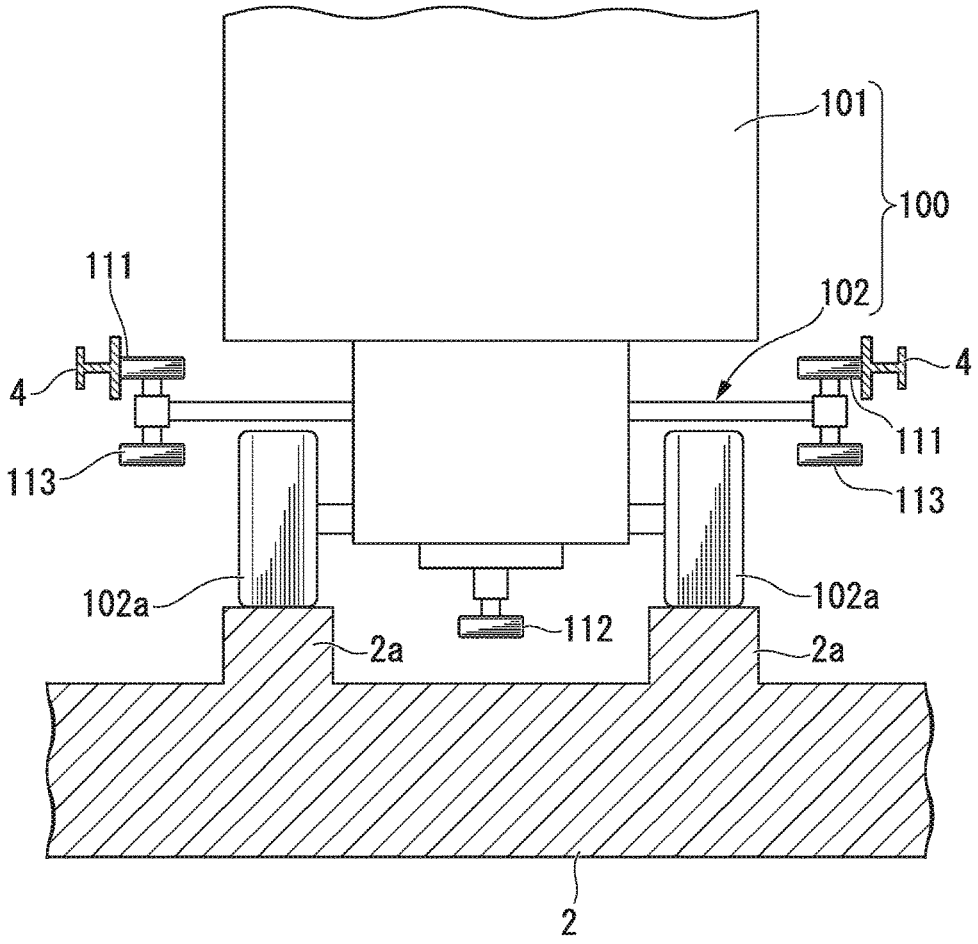
FIG. 2 is a front view showing a vehicle which is running on a main track of the intersecting track according to the embodiment of the present invention.

As shown in FIG. 1, the intersecting track 1 includes two main tracks 2 on which a vehicle 100 runs, first guide portions 4 that are disposed in the main tracks 2 and guide the vehicle 100, a pair of crossover tracks 3 that are disposed between the main tracks 2, second guide portions 5 that are disposed on the pair of crossover tracks 3 and guides the vehicle 100, switching portions 6 that guide a running direction of the vehicle 100 to a direction along any one of the main tracks 2 and the crossover tracks 3, and a switching device 7 that is disposed on the crossover tracks 3.

Here, the vehicle 100 that runs on the intersecting track 1 according to this embodiment includes a vehicle body 101 that accommodates passengers or luggage, a running carriage 102 that is disposed under the vehicle body 101 to support the vehicle 101 and has rubber tires 102*a* capable of running on the main tracks 2 and the crossover tracks 3, a pair of first guide wheels 111 that are disposed on both side parts of the running carriage 102, and a second guide wheel 112 that is disposed on the bottom of the running carriage 102.

The both side parts of the running carriage 102 are provided with switching wheels 113 disposed under the first guide wheels 111 to correspond to the pair of first guide wheels 111.

Here, the both side parts of the running carriage 102 refer to both side parts in a width direction which intersects an extending direction of the main tracks 2 and an extending direction of the crossover tracks 3, that is, the running direction of the vehicle 100.

The two main tracks 2 are arranged in the width direction and constitute a so-called double-tracked structure in which the vehicle 100 can run in different directions on the main tracks 2.

Each main track 2 includes running paths 2*a* which protrude upward from a track surface and on which rubber tires 102*a* roll.

The first guide portion 4 is a guide rail which is disposed on the both side parts in the width direction of each main track 2 and allows the first guide wheel 111 to come into contact therewith and roll. The first guide portion 4 extends in the extending direction of the main track 2 and is supported by a support member which is not shown and which protrudes upward from a track top surface.

That is, in the main tracks 2 according to this embodiment, a so-called side guide system in which the vehicle 100 is guided on the both side parts in the width direction is employed.

The crossover tracks 3 are disposed to be interposed between the two main tracks 2 in the width direction of the main tracks 2, allow the vehicle 100 to run from a first main track 2A (on an upper side of the paper surface of FIG. 1) to a second main track 2B (on a lower side of the paper surface of FIG. 1), and enable the vehicle 100 to move between the main tracks 2A and 2B. The crossover tracks 3 include running paths 3*a* which branch from the running paths 2*a* of the main tracks 2 and protrude from a track surface on the crossover tracks 3 and on which the rubber tires 102*a* roll.

The crossover tracks 3 are disposed as a pair to intersect each other and constitute a so-called X branch.

Between a position at which the crossover tracks 3 intersect each other and parts connected to the main tracks 2, crossover track guide portions 11 are disposed on a first side (a side which is separated from the main tracks 2) in the width direction in the crossover tracks 3. The crossover track guide portions 11 guide the vehicle 100 along the crossover tracks 3 by causing a switching wheel 113 of the running carriage 102 to come into contact therewith and to roll.

The second guide portion 5 is disposed at a central position inward in the width direction of each crossover track 3 and is a member having a groove 5*a* through which enables the second guide wheel 112 to pass and which guides the second guide wheel 112 from both sides in the width direction of the crossover track 3.

That is, in the crossover tracks 3 according to this embodiment, a so-called center guide system in which the vehicle 100 is guided by a central part in the width direction is employed.

The groove 5*a* is disposed to extend to positions which partially overlap positions at which the crossover track guide portions 11 are formed in the running direction of the vehicle 100.

The switching portion 6 is disposed in each main track 2 in front of a position at which the crossover track 3 branches from the main track 2.

The switching portion 6 includes a pair of switching guide portions 13 (see FIG. 4A) that are disposed on each main track 2 below the guide rail as the first guide portion 4 disposed on both side parts and a switching portion switch 12 that can switch the direction of the pair of switching guide portions 13.

Figure 4A:
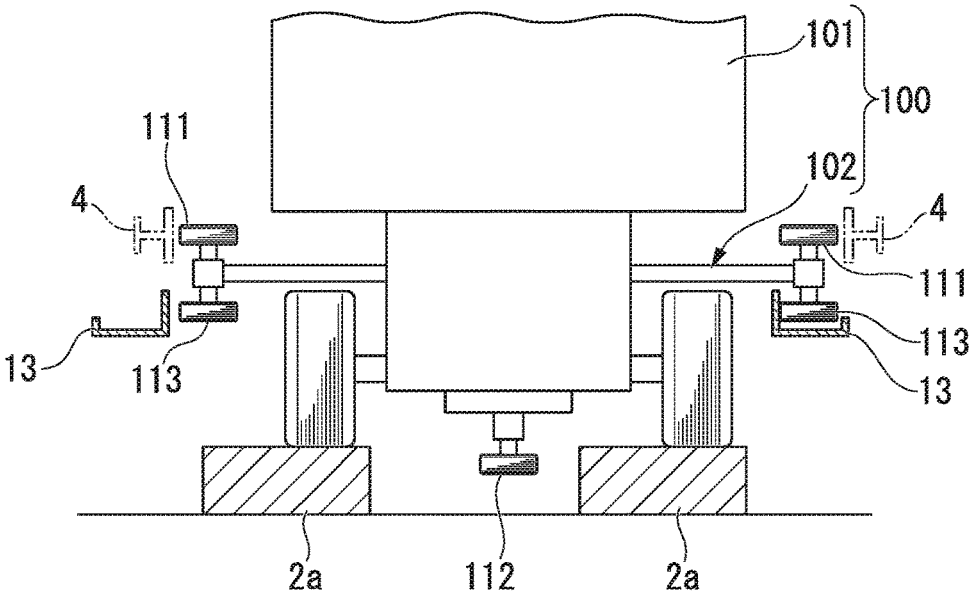
FIG. 4A is a front view showing a state in which a vehicle runs toward the main track and a running direction of the vehicle is switched by the switching portion of the intersecting track according to the embodiment of the present invention and is a cross-sectional view taken along line B-B in FIG. 3.
Figure 4B:
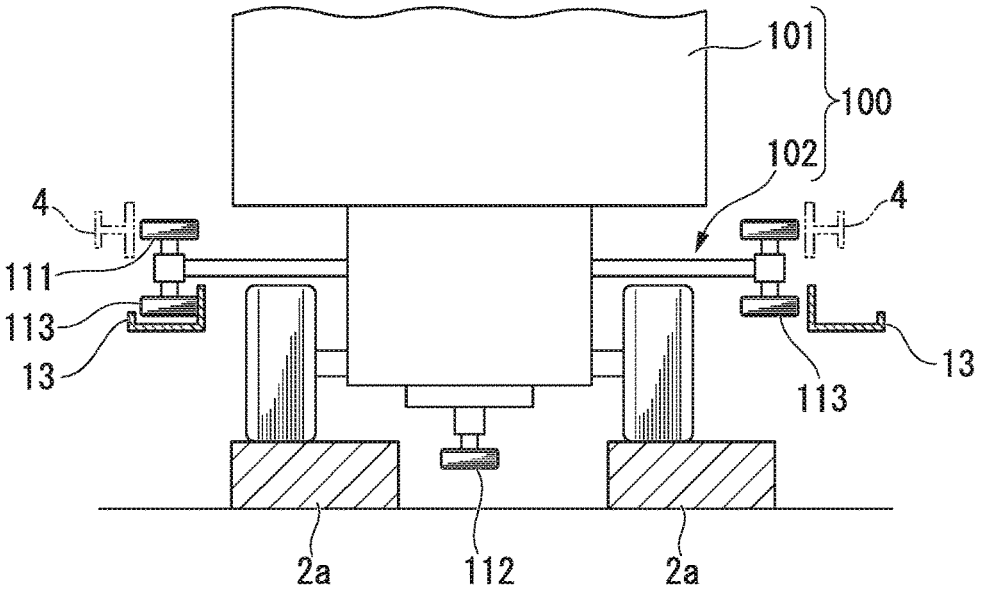
FIG. 4B is a front view showing a state in which a vehicle runs toward a crossover track and a running direction of the vehicle is switched by the switching portion of the intersecting track according to the embodiment of the present invention and is a cross-sectional view taken along line B-B in FIG. 3.

As shown in FIGS. 4A and 4B, the switching guide portions 13 are guide rails having substantially the same cross-sectional shape as the crossover track guide portions 11. Specifically, the switching guide portion is a member having an L-shaped cross-sectional surface and having an engagement face which the switching wheel 113 comes into contact with on an inside thereof in the width direction and which the switching wheel rolls on.

The switching portion switch 12 includes a rod portion 15 that is coupled to the pair of switching guide portions 13 and moves forward and backward in the width direction of the main track 2 and a switch driving unit 16 that is disposed at a position between the two main tracks 2A and 2B and supports the rod portion 15 to move forward and backward.

The rod portion 15 is fixed to an end of the switching guide portion 13 on a side away from a connection portion of the main track 2 and the crossover track 3, enables the pair of switching guide portions 13 to swing in the width direction of the main track 2 about an end on a side close to the connection portion of the main track 2 and the crossover track 3, and switches the running direction of the vehicle 100.

Figure 3:
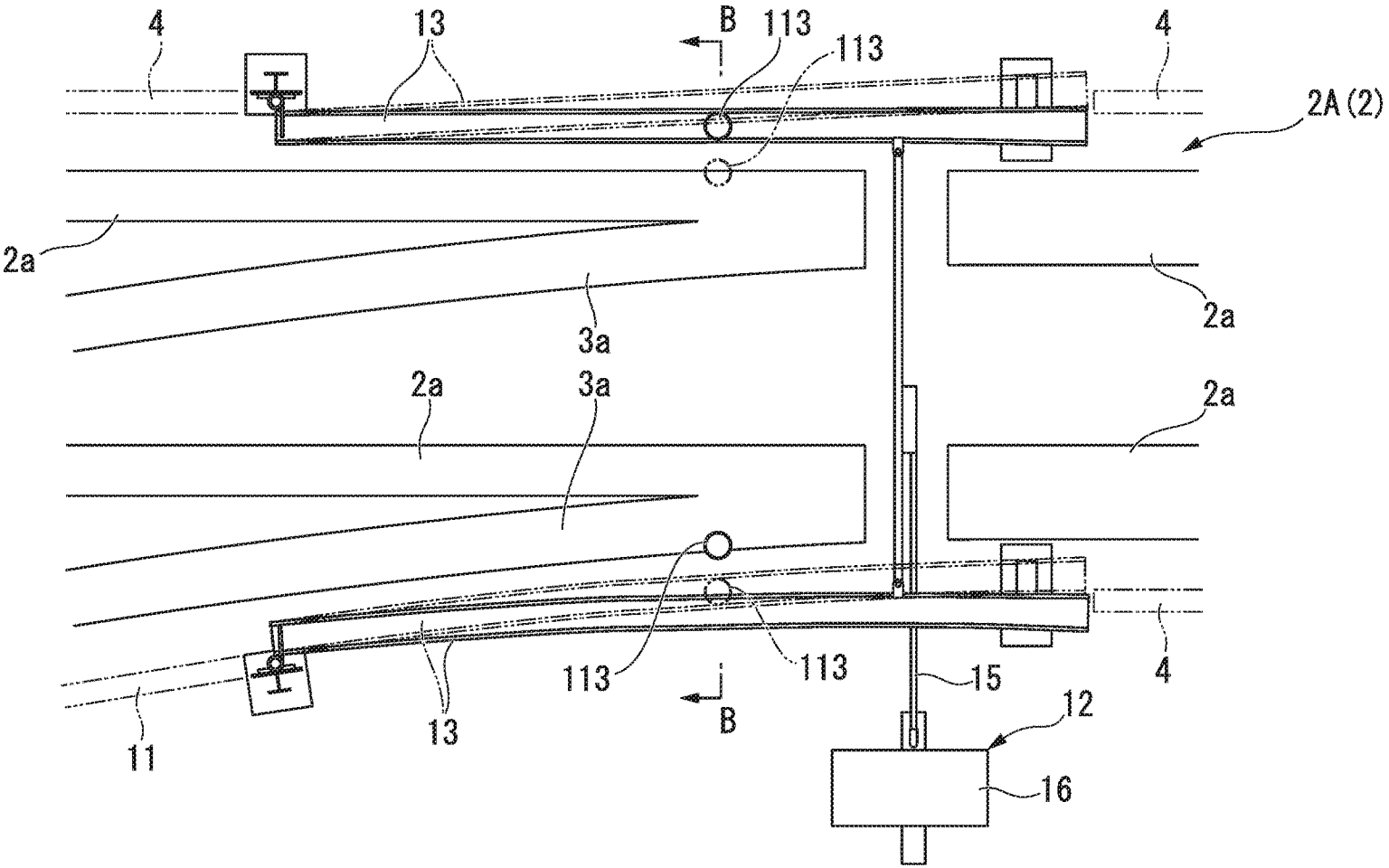
FIG. 3 is a top view showing the main track at a position at which a switching portion of the intersecting track according to the embodiment of the present invention is disposed and is an enlarged view of part A in FIG. 1.

More specifically, as indicated by a solid line in FIG. 3 and as shown in FIG. 4A, when the switching guide portions 13 are switched to a direction along the main track 2, the switching wheels 113 of the vehicle 100 come into contact with only the switching guide portion 13 on the first side in the width direction of the main track 2 and roll, and the vehicle 100 is pulled to a second side in the width direction of the main track 2 and runs in the direction along the main track 2.

On the other hand, as indicated by a two-dot chain line in FIG. 3 and as shown in FIG. 4B, when the switching guide portions 13 are switched to the direction along the crossover track 3, the switching wheels 113 of the vehicle 100 come into contact with only the switching guide portion 13 on the second side (the side on which the crossover track 3 is disposed) in the width direction of the main track 2 and roll, and the vehicle 100 is pulled to the second side in the width direction of the main track 2 and runs in the direction along the crossover track 3.

When the switching guide portions 13 are switched to the direction along the crossover track 3, the switching guide portion 13 on the second side in the width direction of the main track 2 is disposed to be connected to the crossover track guide portion 11 and the switching wheel 113 of the vehicle 100 is smoothly delivered from the switching guide portion 13 to the crossover track guide portion 11.

As shown in FIG. 1, the switching device 7 is disposed in an intersecting area of the second guide portions 5 on the pair of crossover tracks 3.

Figure 5A:
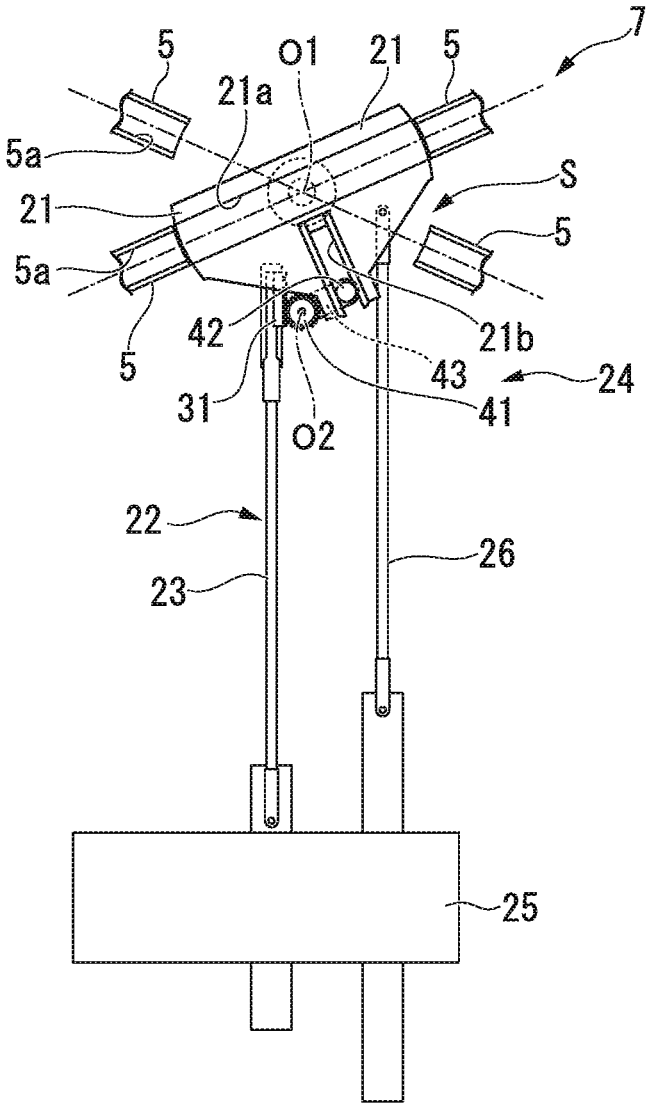
FIG. 5A is a top view showing a switching device of the intersecting track according to the embodiment of the present invention and shows a case in which a vehicle runs on a first crossover track.

As shown in FIG. 5A, the switching device 7 includes a rotating body 21 that is disposed in an area in which grooves 5*a* formed in the second guide portions 5 intersect each other and a rotation driving unit 22 that rotationally drives the rotating body 21.

Here, in this embodiment, the second guide portions 5 are not disposed at the center of the intersecting area of the crossover tracks 3, but a space S at which track top faces are exposed is formed at the center.

The area in which the grooves 5*a* intersect each other in this embodiment refers to an area in which extension lines of the grooves 5*a* passing through the center of the intersecting area intersect each other.

The rotating body 21 is disposed in the space S and is supported by the crossover tracks 3 so as to be rotatable on the track top face about a rotation axis O1 passing through the center of the intersecting area.

A guide groove 21*a* that extends in a direction intersecting the rotation axis O1 is formed in the rotating body 21, the second guide wheel 112 of the vehicle 100 can pass through the guide groove 21*a*, and the second guide wheel 112 comes into contact with and is inserted into the guide groove and is guided.

A link groove 21*b* that extends outward in a radial direction of the rotation axis O1 from the rotation axis O1 is formed in the rotating body 21.

The rotation driving unit 22 includes a rod portion 23 that is disposed to be movable forward and backward along the track surface in the direction intersecting the rotation axis O1 of the rotating body 21, a forward and backward driving unit 25 that causes the rod portion 23 to move forward and backward, and a link portion 24 that is interposed between the rod portion 23 and the rotating body 21.

A first end of the rod portion 23 is provided with a rack gear 31.

The forward and backward driving unit 25 is disposed in an area which is interposed between the two crossover tracks 3 and the second main track 2B in this embodiment. A second end of the rod portion 23 is supported by the forward and backward driving unit 25 such that the rod portion 23 is movable forward and backward.

The link portion 24 includes a pinion gear 41 that is disposed in the crossover track 3 so as to engage with the rack gear 31 of the rod portion 23 and to be rotatable on the track top face about an axis O2 parallel to the rotation axis O1, a support portion 42 that is disposed in the link groove 21*b* of the rotating body 21 and is disposed to be movable in the radial direction of the rotation axis O1 along the link groove 21*b*, and a connection portion 43 that connects the pinion gear 41 and the support portion 42.

Here, the rotation driving unit 22 in this embodiment is provided with a follower rod portion 26 that is interposed between the rotating body 21 and the forward and backward driving unit 25, moves forward and backward and rotates in response to the forward and backward movement of the rod portion 23 and the rotation of the rotating body 21, and limits the wobble of the rotating body 21.

An operation of the rotation driving unit 22 will be described below.

As shown in FIG. 5A, when the rod portion 23 is moved in a direction in which the rod portion 23 approaches the rotation axis O1 by the forward and backward driving unit 25, the pinion gear 41 is rotated about the axis O2 by the rack gear 31. Then, the support portion 42 moves in the link groove 21*b* of the rotating body 21 and a force in a direction which spaces the link groove 21*b* apart from the rack gear 31 acts on the rotating body 21 from the support portion 42.

Accordingly, the rotating body 21 rotates about the rotation axis O1 and causes grooves 5*a* in first crossover track 3 to communicate with each other via the guide groove 21*a* of the rotating body 21. That is, the rotating body 21 is positioned at a position at which the grooves 5*a* and the guide groove 21*a* of first crossover track 3 can smoothly guide the second guide wheel 112.

Figure 5B:
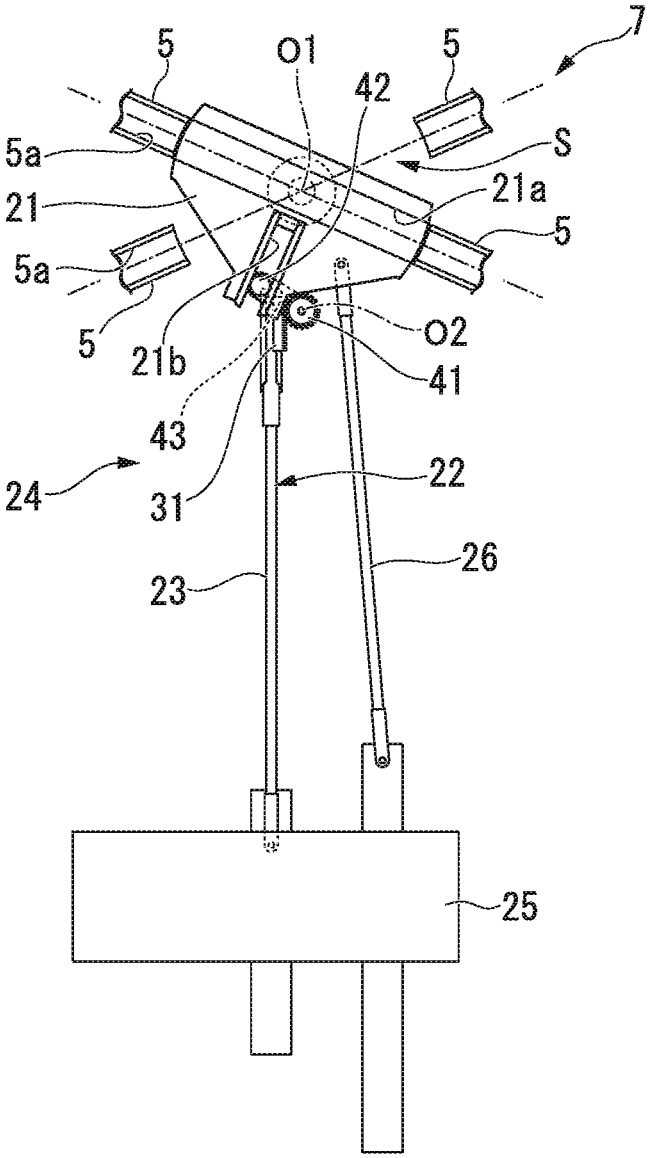
FIG. 5B is a top view showing the switching device of the intersecting track according to the embodiment of the present invention and shows a case in which a vehicle runs on a second crossover track.

On the other hand, as shown in FIG. 5B, when the rod portion 23 is moved in a direction which spaces the rod portion apart from the rotation axis O1 by the forward and backward driving unit 25, the pinion gear 41 is rotated about the axis O2 by the rack gear 31. Then, the support portion 42 moves in the link groove 21*b* of the rotating body 21 and a force in a direction in which the link groove 21*b* approaches the rack gear 31 acts on the rotating body 21 from the support portion 42.

Accordingly, the rotating body 21 rotates about the rotation axis O1 and causes grooves 5*a* in the second crossover track 3 to communicate with each other via the guide groove 21*a* of the rotating body 21. That is, the rotating body 21 is positioned at a position at which the grooves 5*a* and the guide groove 21*a* of the second crossover track 3 can smoothly guide the second guide wheel 112.

In this way, the switching device 7 can selectively switch a direction to the direction along the second guide portions 5 on a first side and the direction along the second guide portions 5 on a second side and can guide the second guide wheel 112 in any one of the directions.

According to the intersecting track 1, the main track 2 employs a side guide system in which the vehicle 100 is guided by the first guide portions 4, and the crossover track 3 employs a center guide system in which the vehicle 100 is guided by the second guide portions 5. Accordingly, unlike a case in which the crossover track 3 also employs the side guide system, it is possible to reduce an overlapping section which is disposed to deliver the vehicle 100 from the first guide portions 4 on the first side to the first guide portions 4 on the second side.

Specifically, in a case in which the crossover track employs the side guide system, the vehicle 100 needs to be guided from a state in which a guide wheel at a first side part of the vehicle 100 is guided by a guide rail at the first side part to a state in which a guide wheel at a second side part of the vehicle 100 is guided by a guide rail at the second side part in order for the vehicle 100 to move from the first main track 2 to the second main track 2 through the crossover track. That is, in order to maintain a state in which the vehicle 100 is always guided by the guide rails while running on the crossover track, the guide rail in the first side part and the guide rail in the second side part need to overlap in the direction along the crossover track in a partial section of the crossover track. Accordingly, an occupation range including the width of the crossover track disposed between the two main tracks 2 in addition to the width of the two main tracks 2 as a whole is required for a position at which the crossover track is disposed.

In this regard, according to this embodiment, since the crossover track 3 of the center guide system is employed as the crossover track, it is possible to reduce the overlapping section.

In the main track 2, since the vehicle 100 is guided in the side guide system, it is possible to stably run at a high speed.

In order to achieve a stable high-speed running in the center guide system, it is necessary to dispose the guide rail as the second guide portion 5 at a higher position. In this case, a structure of the main track 2 is complicated and an increase in costs is unavoidable. In this regard, according to this embodiment, it is possible to achieve both stability of high-speed running and suppression of an increase in costs by employing the side guide system for the main track 2.

The switching device 7 is disposed in the space S formed in the intersecting area of the second guide portions 5 in the crossover tracks 3 and the vehicle 100 can be made to run in the center guide system by operating only the switching device 7. That is, by employing the switching device 7, it is not necessary to select the running direction of the vehicle 100 by switching the crossover tracks 3 as a whole even when employing a so-called X branch in which the crossover tracks 3 are disposed to intersect each other.

Accordingly, unlike a case in which the crossover tracks 3 are switched as a whole, it is not necessary to use a large-scale mechanism which can support a weight of the vehicle 100 and the like. Therefore, it is possible to limit the facility size of the intersecting track 1 as a whole to a maximum extent to suppress an increase in costs and to shorten the switching section by employing the X branch.

In this embodiment, the running direction of the vehicle 100 is selected by rotationally driving the rotating body 21 of the switching device 7. That is, since the rotating body 21 is made to operate on the track surfaces of the crossover tracks 3, it is not necessary to dispose constituent components of the switching device 7 below the crossover tracks 3. Accordingly, since the crossover tracks 3 do not need to be disposed at a higher position, it is possible to limit the length of a prop of the crossover track 3 and to limit the volume of a material (such as concrete and steel) required for constructing the prop.

Here, when it is intended to install the crossover tracks 3 at a higher position, the main tracks 2 need to be installed at a higher position to correspond to the crossover tracks 3. Accordingly, there is a problem in that costs of the intersecting track 1 as a whole increase. In this regard, according to this embodiment, it is possible to avoid this problem by employing the switching device 7 including the rotating body 21.

Since the guide groove 21*a* guiding the second guide wheel 112 from the width direction is formed in the rotating body 21, it is possible to suppress rocking of the vehicle 100 in the width direction of the crossover tracks 3 to secure a course of the vehicle 100 and to improve ride quality.

In the switching device 7, since the rotating body 21 is rotated by a linear driving mechanism using the rod portion 23, the forward and backward driving unit 25 causing the rod portion 23 to move forward and backward can be disposed on a plane along the track surface of the crossover tracks 3. Accordingly, the forward and backward driving unit 25 does not need to be disposed under the crossover tracks 3. As a result, the crossover tracks 3 do not need to be disposed at a higher position and it is possible to limit the length of the prop of the crossover tracks 3 and to limit the volume of a material (such as concrete and steel) required for constructing the prop.

In the switching device 7, the rotating body 21 is not rotated directly but is rotated via the link portion 24. Accordingly, it is possible to absorb backlash in the rack gear 31 and the pinion gear 41 or displacement of the rotating body 21 due to thermal expansion or contraction of the rod portion 23. Accordingly, it is possible to improve the positioning accuracy of the rotating body 21 without using a particular stopper mechanism or the like and to smoothly guide the second guide wheel 112, thereby causing the vehicle 100 to smoothly run on the crossover tracks 3.

In the switching device 7, by indirectly rotating the rotating body 21 using the link portion 24, a load from the vehicle 100 is not directly applied to the forward and backward driving unit 25 and it is thus possible to improve the durability of the forward and backward driving unit 25.

In the intersecting track 1 according to this embodiment, since the switching device is disposed in the intersecting area of the crossover tracks 3, it is possible to implement a simple structure using an X-branched structure and to shorten the switching section.

While an embodiment of the present invention has been described above in detail, the embodiment can be slightly modified in design without departing from the technical spirit of the present invention.

For example, in the switching device 7, the rotating body 21 is rotated by engagement of the rack gear 31 disposed in the rod portion 23 with the pinion gear 41, but a worm may be disposed in the rod portion 23 and a worm wheel engaging with the worm may be disposed in the link portion 24. A gear mechanism, a chain mechanism, or the like which rotates the rotating body 21 without using the link portion 24 may also be disposed.

In the switching device 7, the running direction of the vehicle 100 is selected by rotationally driving the rotating body 21, but the present invention is not limited to this configuration. The running direction of the vehicle 100 may be selected using a mechanism that pushes a member having the guide groove 21*a* formed therein up to the track surface only at a time of running of the vehicle 100.

Instead of the member having the groove 5*a* formed therein, a steel member having a C-shaped cross-section or the like may be used as the second guide portion 5. That is, the second guide portion 5 is not particularly limited as long as the second guide wheel 112 can come into contact therewith and roll. The same is true of the rotating body 21 disposed in the switching device 7.

In the above-mentioned embodiment, an example in which the switching device 7 is applied to the intersecting track 1 including the main tracks 2 of a side guide system has been described, but the switching device 7 may be applied to an intersecting track including main tracks of a center guide system.

INDUSTRIAL APPLICABILITY

According to the intersecting track and the switching device, since the switching device is disposed in the intersecting area of the crossover tracks, it is possible to shorten the switching section with a simple structure.

REFERENCE SIGNS LIST

1 Intersecting track
2 (2A, 2B) Main track
2*a* Running path
Crossover track
3*a* Running path
4 First guide portion
5 Second guide portion
5*a* Groove
6 Switching portion
7 Switching device
11 Crossover track guide portion
12 Switching portion switch
13 Switching guide portion

15 Rod portion
16 Switch driving unit
21 Rotating body
21*a* Guide groove
21*b* Link groove
22 Rotation driving unit
23 Rod portion
24 Link portion
25 Forward and backward driving unit
26 Follower rod portion
31 Rack gear
41 Pinion gear
42 Support portion
43 Connection portion
O1 Rotation axis
O2 Axis
100 Vehicle
101 Vehicle body
102 Running carriage
102*a* Rubber tire
111 First guide wheel
112 Second guide wheel
113 Switching wheel
S Space

What is claimed is:

1. An intersecting track comprising:

two main tracks on which a vehicle runs;

a pair of first guide portions that are disposed in the two main tracks and guide a pair of first guide wheels on both side parts of the vehicle on an outside thereof;

a pair of crossover tracks that are disposed over the two main tracks to intersect each other and enable the vehicle to run between the two main tracks;

a second guide portion that is disposed inside each of the pair of crossover tracks and guides a second guide wheel disposed under the vehicle;

a switching portion that is disposed in each of the main tracks and switches a direction of the vehicle to a direction along the main track and a direction along the crossover track; and a switching device that is disposed in an intersecting area of the second guide portions in the pair of crossover tracks, selectively switches a direction to a direction along one of the second guide portions and a direction along the other of the second guide portions, and guides the second guide wheel in any one of the directions, wherein the switching device includes:

a rotating body that is disposed to be rotatable on top surfaces of the crossover tracks with an axis passing through the center of the intersection area as a rotation axis and guides the second guide wheel; and a driving unit that rotationally drives the rotating body, the driving unit includes:

a rod portion that is disposed to be movable forward and backward in a direction intersecting the rotation axis; and a link portion that causes the rotating body to rotate in response to forward and backward movement of the rod portion, the switching portion includes a pair of switching guide portions that are disposed on each of the main tracks on both side portions of the vehicle and a switching portion switch that switches the direction of the pair of switching guide portions, and the pair of switching guide portions are disposed in the two main tracks below the pair of first guide portions and guide a pair of switching wheels on an inside thereof on both side parts of the vehicle.

2. The intersecting track according to claim 1, wherein the rotating body has a guide groove formed therein which the second guide wheel passes through and which guides the second guide wheel from both sides in a width direction of the crossover track.

3. The intersecting track according to claim 1, wherein the rod portion has a rack gear formed at a first end thereof; and the link portion has a pinion gear which engages with the rack gear and which rotates about an axis parallel to the rotation axis in response to forward and backward movement of the rod portion and causes the rotating body to rotate in response to the rotation of the pinion gear.

4. An intersecting track comprising:

two main tracks on which a vehicle runs;

a pair of first guide portions that are disposed in the two main tracks and guide a pair of first guide wheels on both side parts of the vehicle on an outside thereof;

a pair of crossover tracks that are disposed over the two main tracks to intersect each other and enable the vehicle to run between the two main tracks;

a second guide portion that is disposed inside each of the pair of crossover tracks and guides a second guide wheel disposed under the vehicle;

a switching portion that is disposed in each of the main tracks and switches a direction of the vehicle to a direction along the main track and a direction along the crossover track; and a switching device that is disposed in an intersecting area of the second guide portions in the pair of crossover tracks, selectively switches a direction to a direction along one of the second guide portions and a direction along the other of the second guide portions, and guides the second guide wheel in any one of the directions, wherein the switching device includes:

a rotating body that is disposed to be rotatable on top surfaces of the crossover tracks with an axis passing through the center of the intersection area as a rotation axis and has a guide groove formed therein which the second guide wheel passes through and which guides the second guide wheel from both sides in a width direction of the crossover track; and a driving unit that rotationally drives the rotating body, wherein the driving unit includes:

a rod portion that is disposed to be movable forward and backward in a direction intersecting the rotation axis and has a rack gear formed at a first end thereof; and a link portion that has a pinion gear which engages with the rack gear and which rotates about an axis parallel to the rotation axis in response to forward and backward movement of the rod portion and causes the rotating body to rotate in response to the rotation of the pinion gear, and wherein the driving unit is provided with a follower rod portion that moves forward and backward and rotates in response to the forward and backward movement of the rod portion and the rotation of the rotating body and that limits a wobble of the rotating body, and the switching portion includes a pair of switching guide portions that are disposed on each of the main tracks on both side portions of the vehicle and a switching portion switch that switches the direction of the pair of switching guide portions.

5. A switching device that is disposed in an intersecting track including two main tracks on which a vehicle runs, a first guide portion that is disposed in the two main tracks and guides a first guide wheel of the vehicle, a pair of crossover tracks that are disposed over the two main tracks to intersect each other and enable the vehicle to run between the two main tracks, a second guide portion that is disposed inside each of the pair of crossover tracks and guides a second guide wheel disposed under the vehicle, and a switching portion that is disposed in each of the main tracks and switches a direction of the vehicle to a direction along the main track and a direction along the crossover track, wherein the switching device is disposed in an intersecting area of the second guide portions in the pair of crossover tracks, selectively switches a direction to a direction along one of the second guide portions and a direction along the other of the second guide portions, and guides the second guide wheel in any one of the directions, the switching portion includes a pair of switching guide portions that are disposed on each of the main tracks on both side portions of the vehicle and a switching portion switch that switches the direction of the pair of switching guide portions, the switching device further comprises:

a rotating body that is disposed to be rotatable on top surfaces of the crossover tracks with an axis passing through the center of the intersection area as a rotation axis and has a guide groove formed therein which the second guide wheel passes through and which guides the second guide wheel from both sides in a width direction of the crossover track; and a driving unit that rotationally drives the rotating body, the driving unit includes:

a rod portion that is disposed to be movable forward and backward in a direction intersecting the rotation axis and has a rack gear formed at a first end thereof; and a link portion that has a pinion gear which engages with the rack gear and which rotates about an axis parallel to the rotation axis in response to forward and backward movement of the rod portion and causes the rotating body to rotate in response to the rotation of the pinion gear, and the driving unit is provided with a follower rod portion that moves forward and backward and rotates in response to the forward and backward movement of the rod portion and the rotation of the rotating body and that limits a wobble of the rotating body.

* * * * *